US006190006B1

(12) United States Patent
Kurashima et al.

(10) Patent No.: US 6,190,006 B1
(45) Date of Patent: Feb. 20, 2001

(54) INK-JET RECORDING HEAD

(75) Inventors: Norihiko Kurashima; Shuji Yonekubo; Katsuhiro Okubo, all of Nagano (JP)

(73) Assignee: Seiko Epson Corporation, Tokyo (JP)

( * ) Notice: Under 35 U.S.C. 154(b), the term of this patent shall be extended for 0 days.

(21) Appl. No.: 09/187,091

(22) Filed: Nov. 5, 1998

(30) Foreign Application Priority Data

Nov. 6, 1997 (JP) ..... 9-304574
Feb. 18, 1998 (JP) ..... 10-035891

(51) Int. Cl.[7] ..... B41J 2/045
(52) U.S. Cl. ..... 347/70
(58) Field of Search ..... 347/68–71, 50, 347/40, 72; 310/328–330; 29/890.1; 361/760, 762, 772, 777, 774, 765; 399/261, 241

(56) References Cited

U.S. PATENT DOCUMENTS 5,818,482 * 10/1998 Ohta et al. ..... 347/70
5,889,539 * 3/1999 Kamoi et al. ..... 347/50

FOREIGN PATENT DOCUMENTS 587144 3/1994 (EP) .
659562 6/1995 (EP) .
723866 7/1996 (EP) .
759361 2/1997 (EP) .
822082 2/1998 (EP) .

* cited by examiner

*Primary Examiner*—John Barlow
*Assistant Examiner*—Raquel Yvette Gordon
(74) *Attorney, Agent, or Firm*—Sughrue, Mion, Zinn, Macpeak & Seas, PLLC

(57) ABSTRACT

Segment terminal electrodes for connecting to the segment terminals of TCP and common terminal electrodes at both ends in a direction in which these segment terminal electrodes are arranged are formed on the surface of an actuator unit and the common terminal electrodes at both ends of each row are connected via conductive members. Each grounding conductor on TCP is mutually connected via each common terminal electrode component on the actuator unit. Therefore, the common terminal electrodes on plural actuator units can conduct to grounding conductors.

20 Claims, 12 Drawing Sheets

FIG. 13A
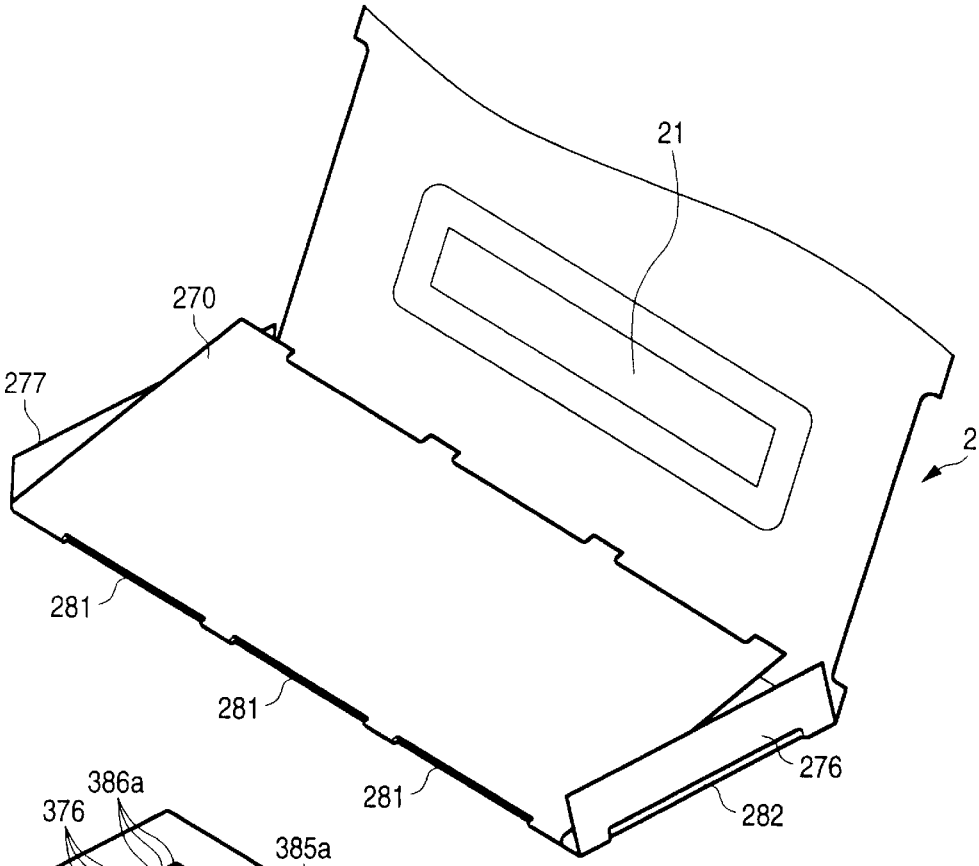
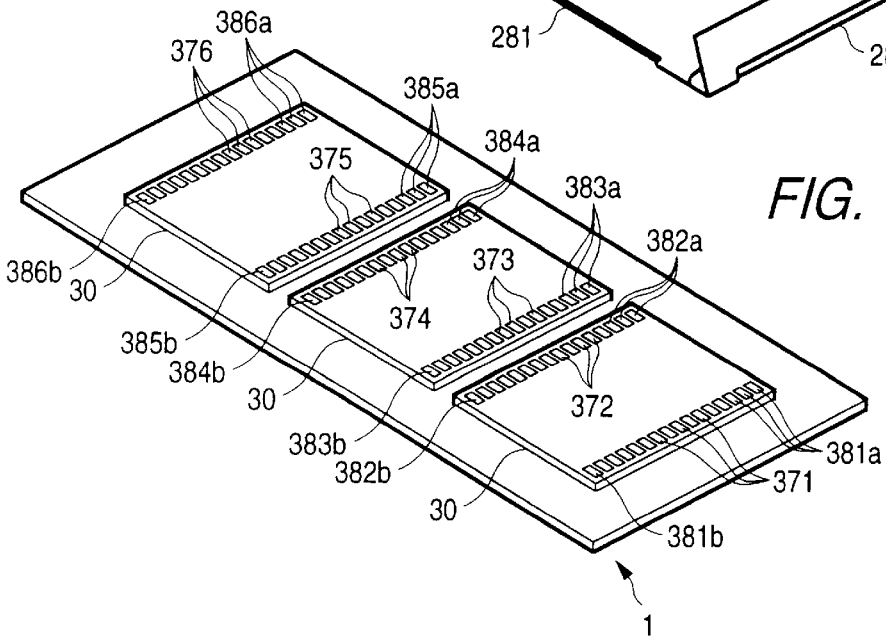
FIG. 13B

INK-JET RECORDING HEAD

BACKGROUND OF THE INVENTION

The present invention relates to an ink-jet recording head for jetting an ink droplet from a nozzle aperture by expanding and contracting the volume of a pressure generating chamber by a piezoelectric vibrator for flexural oscillation so as to print on recording medium. More specifically, the present invention relates to structure for connecting a piezoelectric vibrator and a cable.

In an ink-jet recording head for jetting an ink droplet from a nozzle aperture by expanding and contracting the volume of a pressure generating chamber by a piezoelectric vibrator for flexural oscillation, a piezoelectric vibration plate is arranged on the surface of an elastic plate which is elastically deformable corresponding to each pressure generating chamber and a driving signal is applied to the piezoelectric vibration plate via a flexible cable.

In such a flexible cable, signal lines of the same number as at least the number of piezoelectric vibrators and a common grounding conductor are normally formed on a insulating film in accordance with the array pitch of each piezoelectric vibration plate, each signal line is connected to one electrode of the piezoelectric vibrator and the grounding conductor is connected to the other electrode.

Therefore, if the recording head is miniaturized or the array density of nozzle apertures is enhanced, the width of a signal pattern formed in the flexible cable for supplying a driving signal to each piezoelectric vibrator is necessarily narrowed and its electrical resistance is increased.

As a result, the electric potential difference from the grounding conductor of each piezoelectric vibrator varies, the quantity in which the piezoelectric vibrator is displaced varies and there is a problem that as a result, the characteristic of jetting an ink droplet varies depending upon a nozzle aperture.

To reduce the increase of electrical resistance in a signal pattern, tape carrier package (TCP) technology for mounting a semiconductor integrated circuit for generating a driving signal in an area as close to a piezoelectric vibrator as possible of a flexible cable is adopted. Hereby, as the distance in which a driving signal is transmitted can be reduced, the variation among nozzle apertures of the characteristic of jetting an ink droplet can be reduced.

However, as to realize color printing and high density printing by arranging plural rows of pressure generating chambers in one head, distance between nozzle apertures in each row is required to be reduced as much as possible and the precision of fixing ink on a dot is required to be secured, a terminal for connecting to the grounding conductor, a so-called common terminal can be provided to only one end of a terminal for supplying a driving signal to the piezoelectric vibrator, a so-called segment terminal row.

Therefore, there occurs a new problem that large distance is made between the common terminal electrode located at the other end for piezoelectric vibrators and the grounding conductor, the characteristic of displacement varies among piezoelectric vibrators in the same row and among piezoelectric vibrators in different rows and the characteristic of jetting an ink droplet varies.

Particularly, in a recording head using a piezoelectric vibrator utilizing flexural displacement, the electrode which is formed on the surface of an elastic plate, as a lower electrode is required to be formed as thinly as possible to maintain the elasticity of the elastic plate, electrical resistance is increased and the above problem is more realized.

To solve such problem, a method of increasing the area of the TCP and providing a grounding conductor outside is also conceivable, however, there is a problem that the size of the whole recording head is increased.

For a recording head using TCP in which a driving signal generating semiconductor integrated circuit is mounted on a flexible cable, there is a problem that as the rigidity of the flexible cable is increased, the characteristic related to oscillation of a piezoelectric vibrator varies due to deformation when TCP is connected to a recording head chip and contact between TCP and a piezoelectric vibrator and the characteristic of jetting ink is influenced.

SUMMARY OF THF INVENTION

An ink-jet recording head according to the present invention is provided with plural nozzle openings for jetting ink, a piezoelectric vibrator for expanding or reducing the volume of a pressure generating chamber communicating with a nozzle aperture, a segment terminal electrode provided corresponding to the above piezoelectric vibrator and connected to one pole of the piezoelectric vibrator and a common terminal electrode arranged at both ends in a direction in which the segment terminal electrodes are arranged and connected to the other pole of the piezoelectric vibrator, a tape carrier package having a segment terminal connected to the segment terminal electrode and having the relationship of continuity to a signal pattern for transmitting a driving signal generated based upon an input signal from an external device, a common terminal located at both ends of the segment terminal and connected to the common terminal electrode and a grounding conductor arranged on both sides and on the side of the input signal pattern and connected to the common terminal and a connecting member arranged at both ends of the segment terminal electrode for connecting the common terminal electrode. Owing to such constitution, the common terminal electrode formed at both ends of the actuator unit is securely connected to the grounding conductor in an area of the actuator unit and the electric potential of the piezoelectric vibrator can be prevented from varying.

Therefore, a first object of the ink-jet recording head according to the present invention is to provide an ink-jet recording head in which the electric potential of piezoelectric vibrators in plural rows is fixed possibly and an ink droplet can be stably jetted without increasing the size of the whole recording head.

A second object of the ink-jet recording head according to the present invention is to provide an ink-jet recording head in which TCP and a piezoelectric vibrator are prevented from coming in contact and an ink droplet can be stably jetted.

BRIEF DESCRIPTION OF THE DRAWINGS

FIGS. 13*a* and 13*b* are an exploded perspective drawing showing the ink-jet recording head viewed from the top.

PREFERRED EMBODIMENTS OF THE INVENTION

Figure 1A:
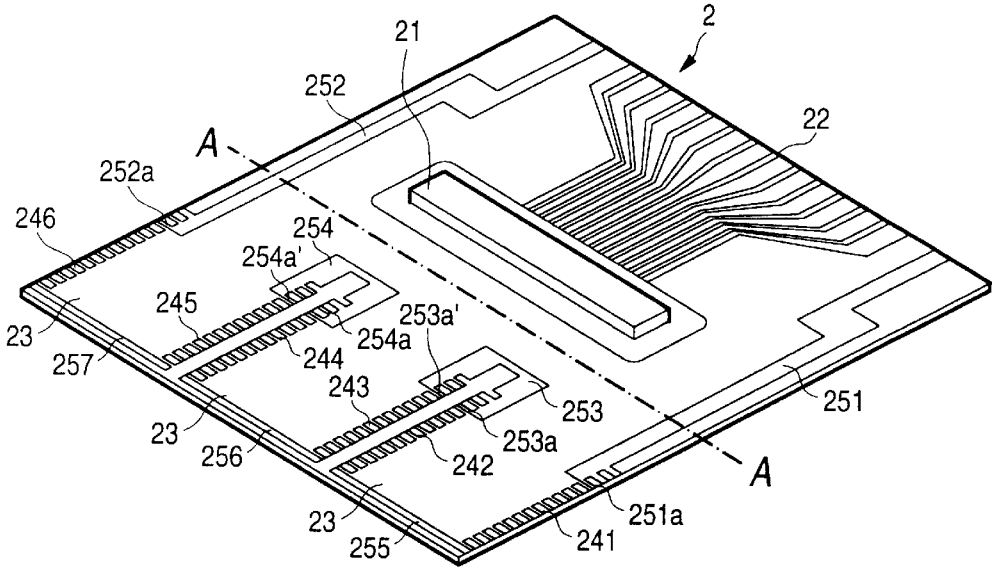
FIGS. 1*a* and 1*b* are a perspective drawing showing a first embodiment of an ink-jet recording head according to the present invention.

Embodiments showing the details of the present invention in the drawings will be described below. However, in FIG. 1, a group of terminals 251*a* to 254*a* and 241 to 246 exposed on the rear side of TCP 2 are shown on the surface side to assist understanding.

Figure 1B:
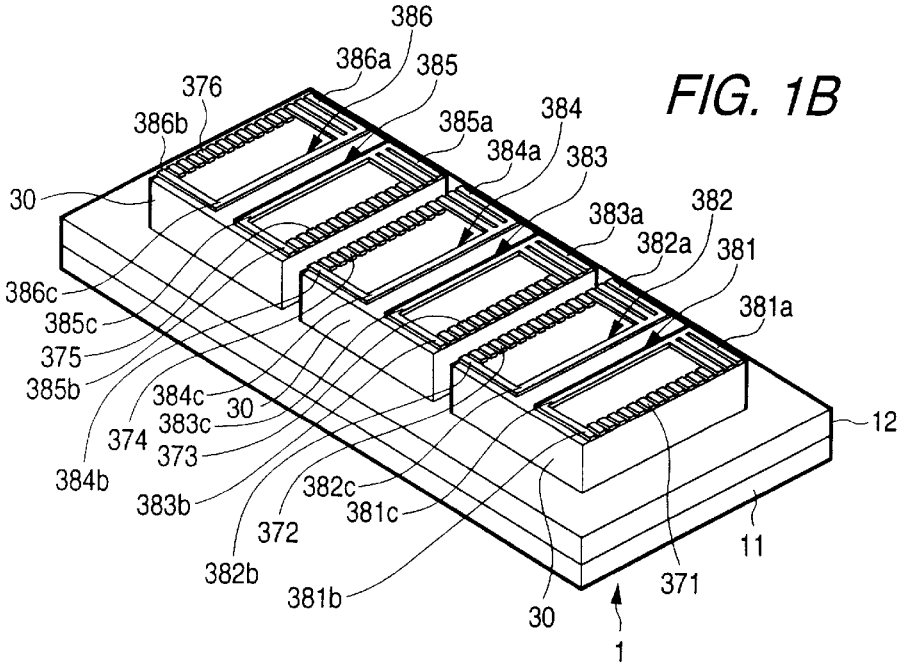
Figure 2A:
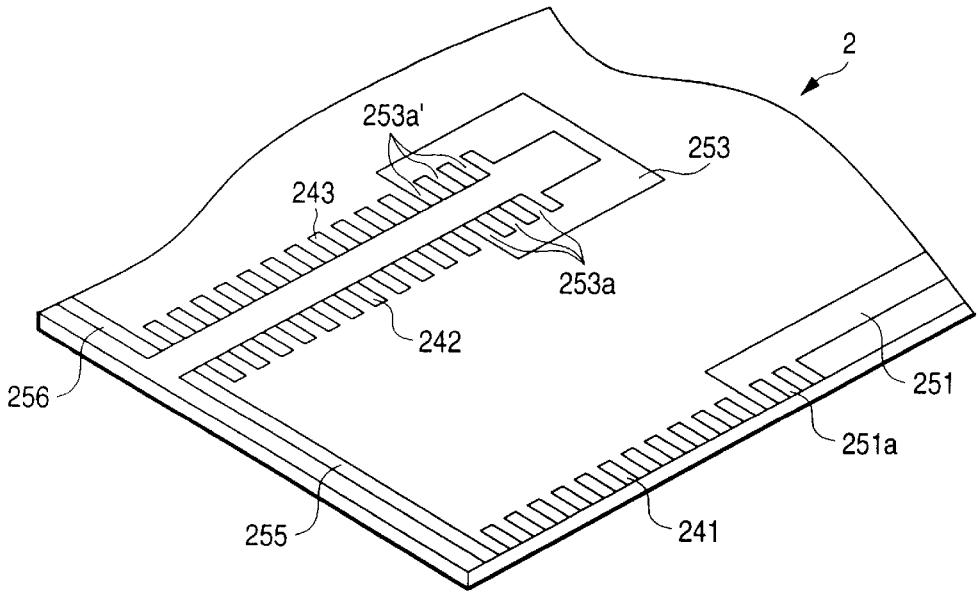
FIGS. 2*a* and 2*b* are a perspective drawing showing one actuator unit in an enlarged state of the above ink-jet recording head.
Figure 2B:
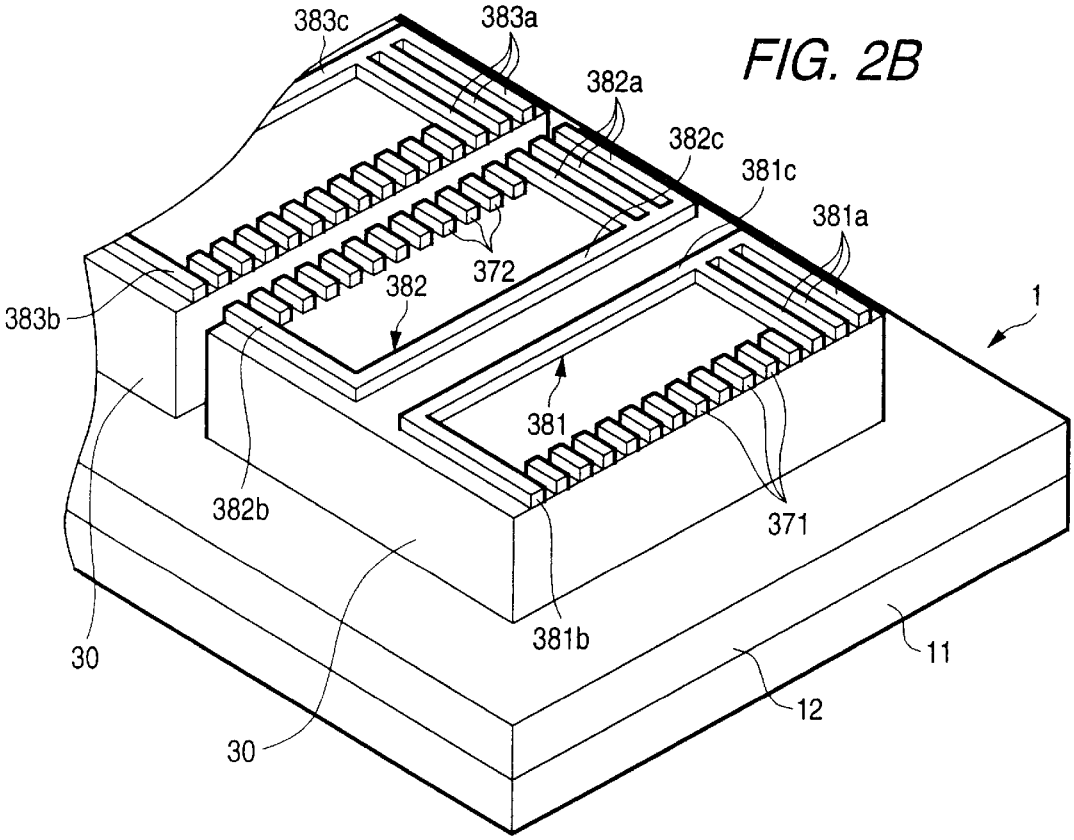

An ink-jet recording head comprises a head chip 1 including a nozzle plate 11, a reservoir plate 12 and plural actuator units 30 (three actuator units 30 are provided in this embodiment), and TCP 2 for supplying a driving signal to each actuator unit 30 as shown in FIG. 1.

TCP 2 is made such that a driving signal generating semiconductor integrated circuit 21 for generating a driving signal according to a printing signal from a host not shown is mounted on a flexible cable, and a required wiring pattern is formed.

Each actuator unit 30 provided to the head chip 1 is arranged corresponding to adjacent each two rows in six rows of nozzle apertures 111 provided to the nozzle plate 11.

A recording head in which ink of different colors is jetted from a nozzle aperture 111 in each row and printing in six colors of ink is enabled can be constituted by such constitution and a recording head in which the arrangement of two nozzle aperture rows corresponding to one actuator unit 30 is shifted by half pitch and higher density printing in three colors of ink is enabled can be achieved by such constitution.

The semiconductor integrated circuit 21 for generating the driving signal, mounted on TCP 2, is connected to an input signal pattern 22 for supplying a printing signal from a host and an output signaL pattern 23 for outputting a driving signal generated by the semiconductor integrated circuit 21 to each actuator unit 30, and the signal patterns 22 and 23 are covered with a resist layer not shown with only a connecting area exposed.

In the connecting area of the output signal pattern 23, segment terminals 241 to 246 are provided in accordance with the arrangement pitch of connecting terminals 371 to 376 of the actuator unit 30.

Grounding conductors 251 and 252 are provided at one end of the segment terminals 241 and 246 on both sides of TCP 2, grounding conductors 253 and 254 installed on the side of the semiconductor integrated circuit 21 are provided between adjacent segment terminals 242 and 243 and between 244 and 245 and further, grounding conductors 255, 256 and 257 are provided on the side of each end of the segment terminals 241 to 246, that is, on the side far from the semiconductor integrated circuit 21 so that each actuator unit 30 is crossed.

Grounding conductors 251 and 252 are respectively divided into plural parts (three in this embodiment) in an area in which each grounding conductor is connected to each common terminal electrode 381*a* and 386*a* described later and connecting terminals 251*a* and 252*a* are formed.

Similarly, grounding conductors 255, 256 and 257 are respectively divided into plural parts (three in this embodiment) in an area in which each grounding conductor is connected to each common terminal electrode 382*a* to 385*a* described later and connecting terminals 253*a* to 254*a*' are formed.

In the meantime, segment terminal electrodes 371 to 376 for respectively connecting to the segment terminals 241 to 246 by soldering and others are formed on the surface of the actuator unit 30, common terminal electrodes 381*a*, 381*b* to 386*a* and 386*b* are formed at both ends in a direction in which the segment terminal electrodes 371 to 376 are arranged, these common terminal electrodes 381*a*, 381*b* to 386*a* and 386*b* in each row extend in a direction in which the segment terminal electrodes 371 to 376 are arranged in the central area of the actuator unit 30 and are respectively connected via conductive members 381*c* to 386*c* formed by the same method as the segment terminal electrodes 371 to 376 and the common terminal electrodes 381*a* to 386*b*.

For these common terminal electrode forming members 381*a*–386*a* and 381*b*–386*b* and conductive members 381*c*–386*c*, explaining the common terminal electrode forming member 381 as an example, the common terminal electrode forming member 381 is provided with ends 381*a* and 381*b* for connecting to TCP 2 on the side of the end in a direction in which the segment terminal electrode 371 is arranged and particularly, the common terminal electrode 381*a* on the side of the semiconductor integrated circuit is divided into plural parts (three in this embodiment).

In case TCP 2 is connected to the head chip 1, each grounding conductor 251 to 257 of TCP is mutually connected via each common terminal electrode 381*a*–386*a* and 381*a*–386*b* and conductive members 381*c*–386*c* on the actuator unit 30 owing to such connecting structure. That is, the grounding conductor 251 is connected to the common terminal electrode 381*a* of three parts via the common terminal 251*a* and is connected to the common terminal electrode 381*b* at the other end via the conductive member 381*c* extended in the central area of the actuator unit 30. The common terminal electrode 381*b* and the common terminal electrode 382*b* on the other side of the same actuator unit 30 are connected via the grounding conductor 255 of TCP 2 and connected to the common terminal electrode 382*a* at the other end via the conductive member 382*c*. The common terminal electrode 382*a* is connected to the common terminal 253*a* of the grounding conductor 253 of TCP 2, is connected to the common terminal 253*a*' on the opposite side via the grounding conductor 253 and is connected to the common terminal 253*a* of the other adjacent actuator unit 30. In the same actuator unit 30, the grounding conductors 251 and 252 arranged on both sides of TCP 2 can be connected via the conductive members 381*c* to 386*c* and the grounding conductors 255 and 257 arranged at the end far from the semiconductor integrated circuit 21 of TCP 2, and between adjacent actuator units 30, the grounding conductors 251 and 252 arranged on both sides of TCP 2 can be connected via the grounding conductors 253 and 254 on the side of the semiconductor integrated circuit 21.

Therefore, the common terminal electrodes 381*a*, 381*b* to 386*a* and 386*b* on the actuator units 30 can be securely connected to the grounding conductors 251 and 252 independent of the number of the actuator units 30.

The common terminal electrodes 381*a* to 386*a* at the end of each common terminal electrode 381 to 386 and on the side of the semiconductor integrated circuit 21 are formed so that they are more than the common terminal electrodes 381*b* to 386*b* at the other end and each total area is larger, and the corresponding pattern structure is applied to the grounding conductors 251 to 254 of TCP 2. Owing to such structure, even if one of three common terminals 251*a* of the grounding conductor 251 for example respectively connected to the three common terminal electrodes 381*a* is peeled because of the bending stress of TCP 2 in case TCP 2 is bent into two between an area in which segment terminals and common terminals are formed and the semiconductor integrated circuit 21, that is, along a line A—A in FIG. 1 and assembled if the whole recording head is miniaturized, continuity can be kept by the residual two. As the heat capacity of one common terminal electrode 381*a* is small because the common terminal electrode is divided, soldering is facilitated, compared with a case that the common terminal electrode is not divided.

Figure 3:
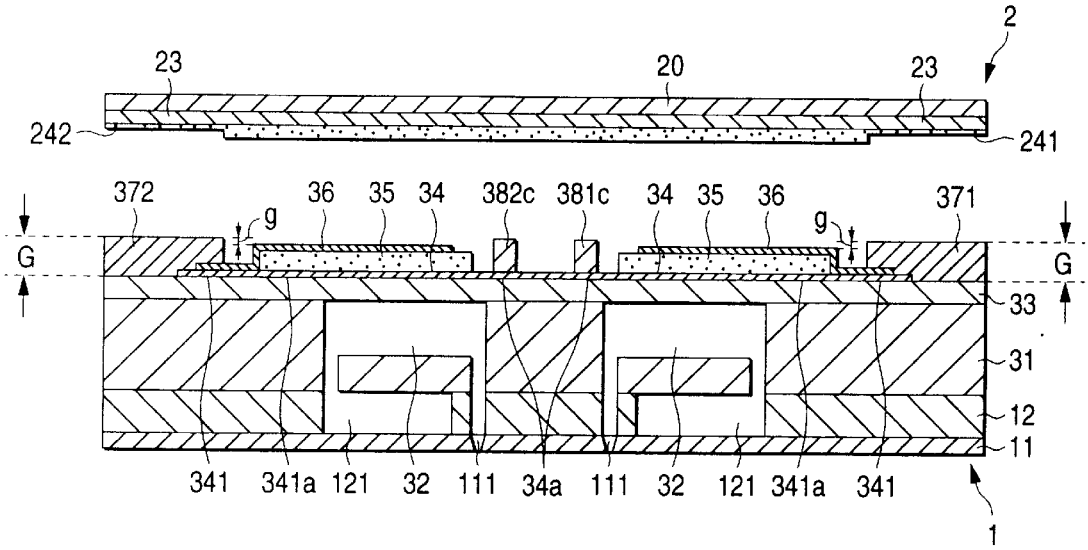
FIG. 3 shows the structure of a head chip and TCP constituting the ink-jet recording head.
Figure 4:
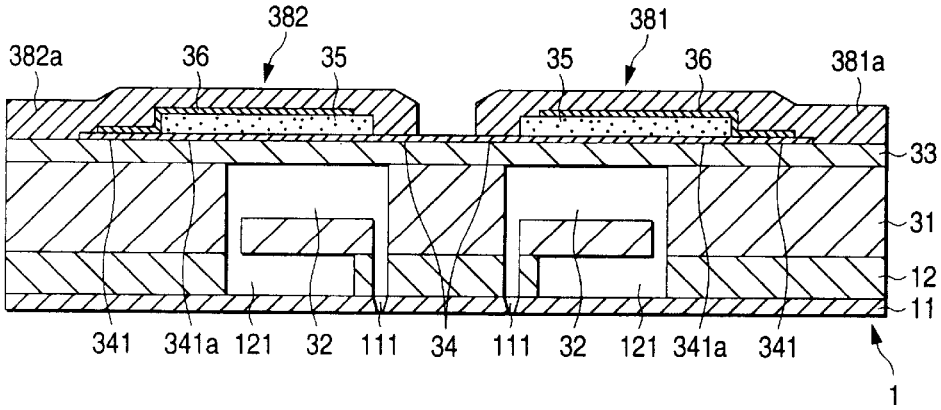
FIG. 4 shows the sectional structure of a common terminal electrode of the head chip.

Referring to FIG. 3, the structure of the segment terminal electrode will be described in detail below, referring to FIG. 4, the common terminal electrode forming member will be described in detail below and further, referring to FIG. 5, the superficial structure of the actuator unit 30 will be described in detail below.

In the head chip 1, the nozzle plate 11 in which nozzle apertures 111 for respectively jetting ink as an ink droplet are made and the reservoir plate 12 in which reservoirs 121 for respectively supplying ink to each pressure generating chamber 32 are formed are bonded fluid-tight by a thermically welding film not shown and others, and the actuator unit 30 is bonded fluid-tight on the surface.

In the actuator unit 30, a pressure generating chamber forming member 31 in which plural pressure generating chambers 32 respectively communicating with the reservoir 121 and each nozzle aperture 111 are formed and an elastic plate 33 for sealing one surface of the pressure generating chamber 32 are baked integrally via ceramic material, a lower electrode 34 as the other pole is formed on the surface of the elastic plate 33, a piezoelectric vibrator 35 is formed on the surface and further, an upper electrode 36 as one pole is formed on the surface of the piezoelectric vibrator 35.

Figure 5:
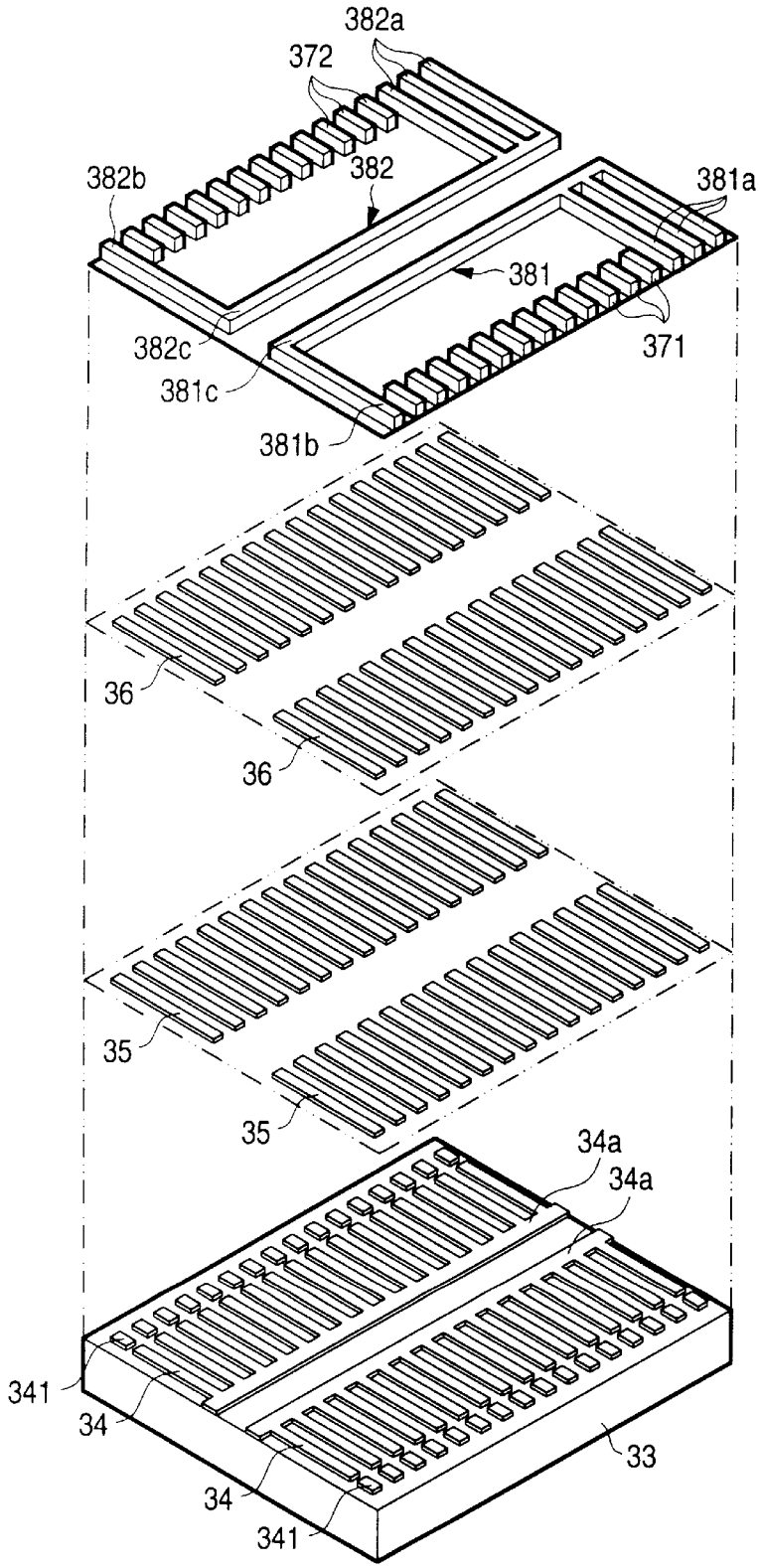
FIG. 5 is an exploded perspective drawing showing an embodiment of an actuator unit constituting the ink-jet recording head.

The lower electrode 34 is formed by platinum (Pt) corresponding to each pressure generating chamber 32 so that it is 1 to 5 $\mu$m thick, as shown in FIG. 5, each is connected via a central area 34*a* and further, conductive members 381*c* and 382*c* are formed by silver (Ag) 10 to 20 $\mu$m thick on the surface of the central area 34*a*.

As described above, as the lower electrode 34 is also connected to the conductive members 381*c* and 382*c*, resistance between each grounding conductor 251 and 252 and the lower electrode 34 is decreased, compared with a case that the lower electrode is connected to the grounding conductors 251 and 252 only at one end in a direction in which the segment terminal electrodes 371 and 372 are arranged, and the electric potential of the lower electrode 34 can be prevented from varying. If a dummy lower electrode 341 is formed so that the lower electrode 34 and the lower electrode 34 are disconnected because of clearance 341*a* and others, joining strength between the piezoelectric vibrator 35 and the elastic plate 33 is readily secured.

In the meantime, the upper electrode 36 is formed by gold (Au) 0.1 to 1 $\mu$m thick on the surface of the piezoelectric vibrator 35 formed corresponding to the lower electrode 34 so that the piezoelectric vibrator is 5 to 15 $\mu$m thick, and the segment terminal electrodes 371 and 372 respectively connected to the connecting terminals 241 and 242 of TCP 2 are formed by silver (Ag) 10 to 20 $\mu$m thick at the end.

The thickness G of the segment terminal electrodes 371 and 372 and the common electrode forming members 381 and 382 is set to the thickness of the piezoelectric vibrator 35 or a larger value, and a step g (see FIG. 3) is secured between the piezoelectric vibrator 35 corresponding to each segment terminal electrode 371 and 372 and each common terminal electrode forming member 381 and 382. Hereby, TCP 2 is located via space between it and the piezoelectric vibrator 35 and mechanical contact between TCP 2 and the piezoelectric vibrator 35 can be prevented.

As the thickness G of each segment terminal electrode 371, 372, 381 and 382 is large, resistance in the whole conductor including the common terminal electrode forming members 381 and 382 is decreased and the variation of electric potential in the lower electrode 34 can be prevented.

Figure 6:
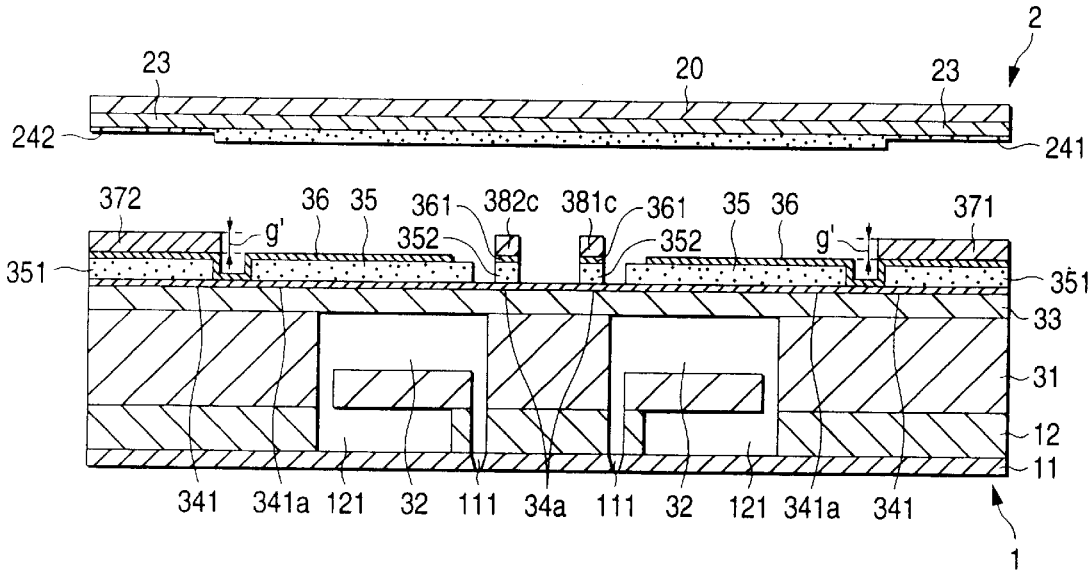
FIG. 6 shows a second embodiment of the ink-jet recording head according to the present invention as the sectional structure of a segment terminal electrode.
Figure 7:
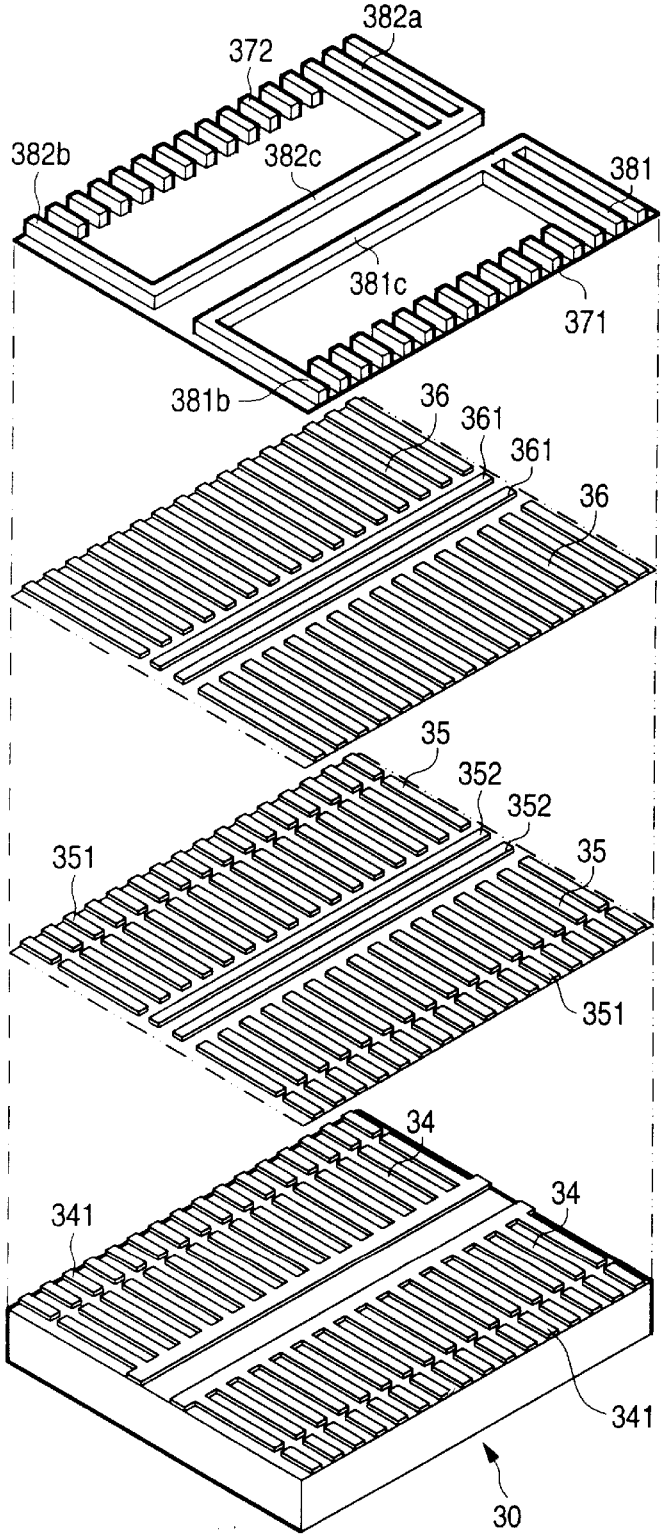
FIG. 7 is an exploded perspective drawing showing an embodiment of the actuator unit of the recording head.

As described later, desirably, as shown in FIGS. 6 and 7, a large step g is made between the piezoelectric vibrator 35 and each common terminal electrode 381*a*, 381*b*, 382*a* and 382*b* by forming dummy piezoelectric vibrators 351 and 352 in an area not opposite to the nozzle aperture 111 and mounting the common terminal electrode forming members 381 and 382 on the surface, and mechanical contact between TCP 2 and the piezoelectric vibrator 35 can be securely prevented.

In the ink-jet recording head constituted as described above, a driving signal is generated in the driving signal generating semiconductor integrated circuit 21 corresponding to a printing signal from an external device such as a host. The driving signal is applied to the segment terminal electrode 371 of the head chip 1 via the pattern 23 of TCP 2 and the segment terminal 241.

The piezoelectric vibrator 35 is flexuously displaced by an electric field between the upper electrode 36 connected to the segment terminal electrode 371 and the lower electrode 34 connected to the grounding conductor 251 via the common terminal electrode 381. Hereby, the elastic plate 33 is displaced, ink in the pressure generating chamber 32 is pressurized and an ink droplet is jetted from the nozzle aperture 111 according to a printing signal.

According to this embodiment, as a driving signal is supplied from one TCP 2 to plural actuator units 30, the recording head can be miniaturized, compared with a case that independent TCP is provided every actuator unit.

At that time, as the plural grounding conductors 251 and 252 of TCP 2 are mutually connected via the common terminal electrode forming members 371 and 372 in one actuator unit 30, the common terminal electrodes 371 and 372 in one actuator unit 30 are grounded at the minimum floating potential and an electric field applied to each piezoelectric vibrator 35 is equalized. Hereby, the displaced quantity of each piezoelectric vibrator 35 of the whole head chip is fixed, an ink droplet with fixed volume can be jetted from each nozzle aperture 111 and high quality of printing is enabled.

FIGS. 6 and 7 show a second embodiment of the ink-jet recording head according to the present invention.

In a process for forming a piezoelectric vibrator 35 on a lower electrode 34 on the surface of an elastic plate 33 of an actuator unit 30, dummy piezoelectric vibrators 351 and 352 are respectively formed in the center and on both sides of the actuator unit 30.

In a process for forming an upper electrode 36 on the piezoelectric vibrator 35, the upper electrode 36 is formed on the dummy piezoelectric vibrator 351 on both sides of the actuator unit 30, a dummy upper electrode 361 not connected to the upper electrode 36 is formed on the dummy piezoelectric vibrator 352 in the center and further, segment terminal electrodes 381 and 382 connected to TCP 2 are formed on the surface of these upper electrodes 36 and 361.

According to this embodiment, the height from the elastic plate in an area in which the segment terminal electrodes 371 and 372 and the common electrode forming members 381 and 382 are formed can be made higher by the thickness of each dummy piezoelectric vibrator 351 and 352 than the height in an area in which the piezoelectric vibrator 35 is formed only by changing the shape of an electrode forming pattern and others without greatly changing the manufacturing process of the ink-jet recording head equivalent to the first embodiment, a gap g' between TCP 2 and the piezoelectric vibrator 35 is sufficiently secured and contact between TCP 2 and the piezoelectric vibrator 35 can be securely prevented.

Figure 8:
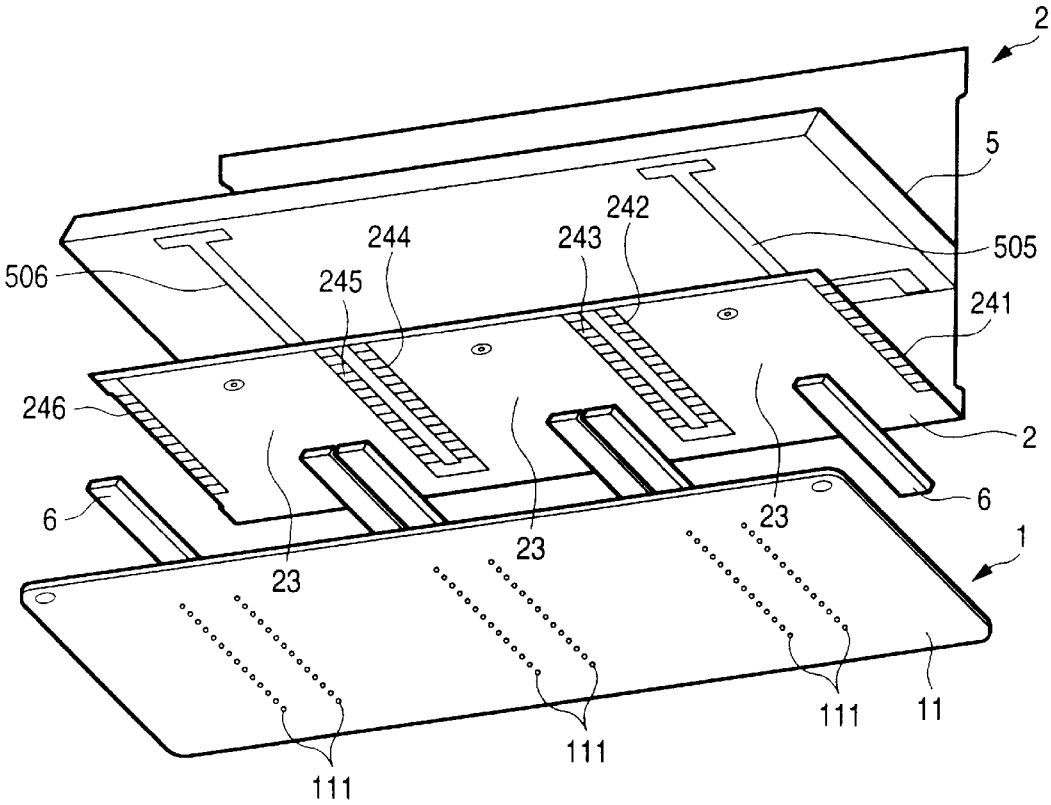
FIG. 8 is an exploded perspective drawing showing a third embodiment viewed from the side of a nozzle aperture of the ink-jet recording head according to the present invention.
Figure 9:
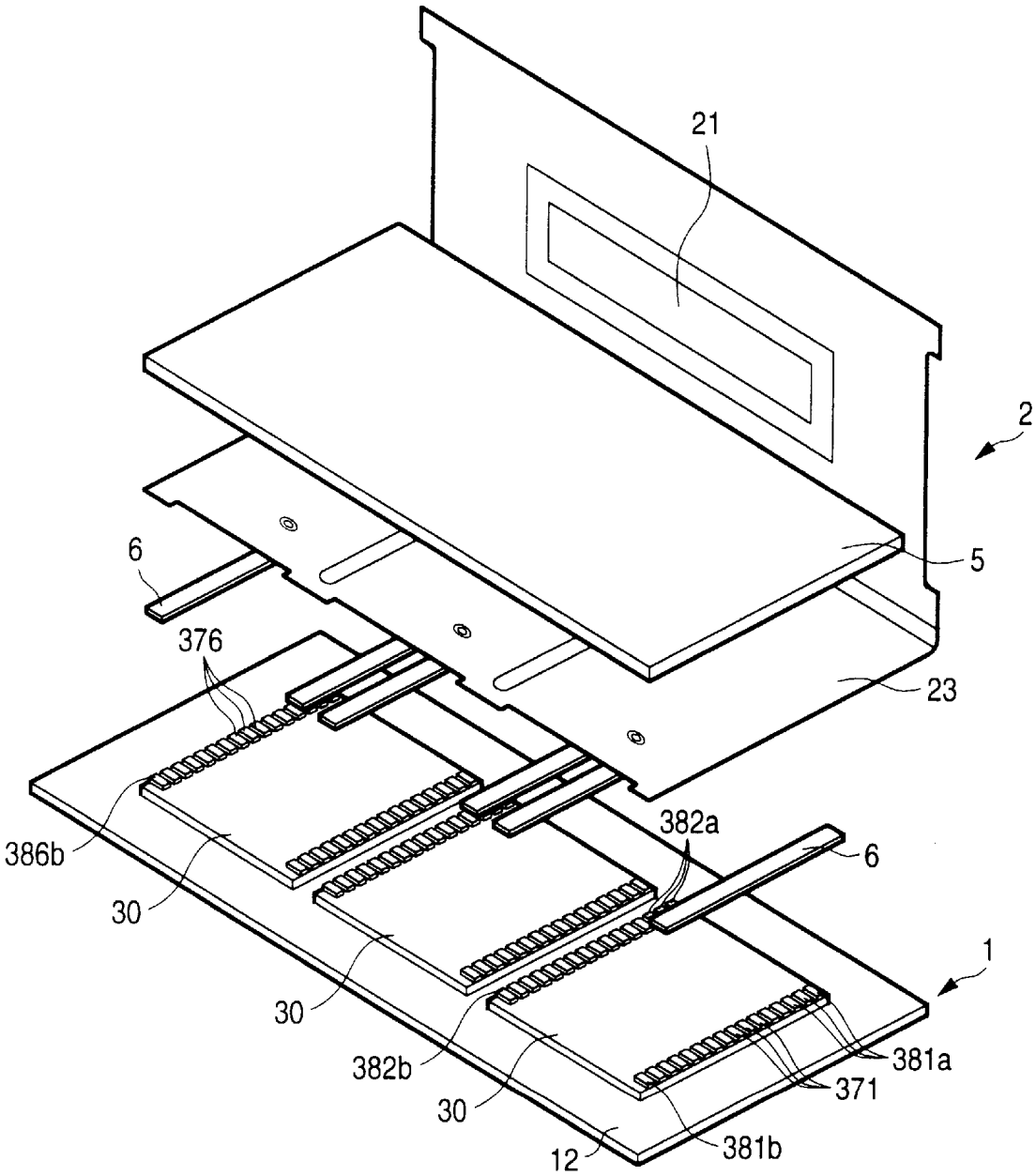
FIG. 9 is an exploded perspective drawing showing the above ink-jet recording head viewed from the top.

FIGS. 8 and 9 show a third embodiment of the ink-jet recording head according to the present invention. In this embodiment, conductive members 381*c* to 386*c* for connecting the common terminal electrodes 381*a*, 381*b* to 386*a*, 386*b* arranged at both ends in a direction in which the segment terminal electrodes 371 to 376 are respectively arranged are not required and instead, the common terminal electrodes 381*a*, 381*b* to 386*a*, 386*b* arranged at both ends in a direction in which these segment terminal electrodes 371 to 376 are respectively arranged are connected via an external conductive member. An anisotropic conductive bonding film 6 is provided for connecting TCP 2 and a terminal which effects conductivity only in a pressurized direction and the above film is formed by mixing thermoplastic polymeric material and minute powder of metal and extending to be a film.

Figure 10:
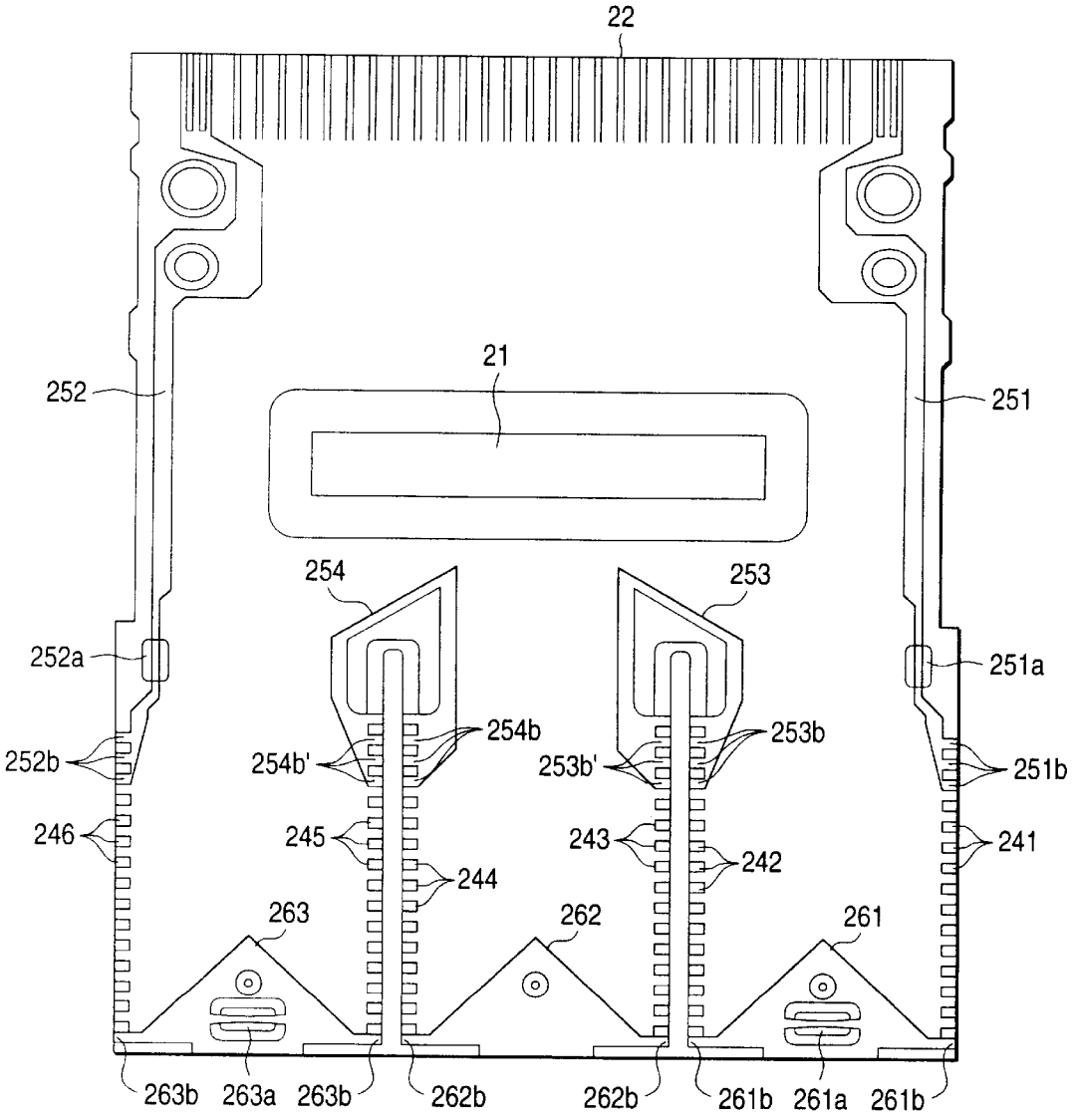
FIG. 10 is a top view showing an embodiment of TCP used for the inkjet recording head.

As shown in FIG. 10, TCP 2 in this embodiment is formed by mounting a semiconductor integrated circuit 21 for generating a driving signal on a flexible cable as in the above embodiments, segment terminals for connection 241 to 246 are provided corresponding to the actuator unit 30 and grounding conductors 251 and 252 are provided on the side of the semiconductor integrated circuit 21 of the segment terminals 241 and 246 on both sides of TCP 2.

Similar grounding conductors 253 and 254 to those in the above embodiments are provided at one end between adjacent segment terminals 242 and 243 and between 244 and 245 and further, triangular grounding areas 261, 262 and 263 provided with larger area than the area of grounding conductors 255 to 257 are provided at the end of the segment terminals 241 to 246.

Windows 251*a*, 252*a*, 261*a* and 263*a* which can be connected to an area opposite to the conductive pattern 500 of a substrate 5 described later by soldering and others are formed in the grounding conductors 251 and 252 and the grounding areas 261 and 263 at both ends of the grounding areas 261 to 263 at the end.

Common terminals 251*b* and 252*b* respectively composed of three parts connected to common electrode terminals 271*a* and 276*a* of the actuator unit 30 are formed at the end of the grounding conductors 251 and 252, common terminals 261*b* to 263*b* respectively composed of three parts are formed at the end of grounding areas 261 and 263 and further, common terminals 253*b*, 253*b*', 254*b* and 254*b*' respectively composed of three parts are formed at the end of grounding conductors 253 and 254.

Figure 11:
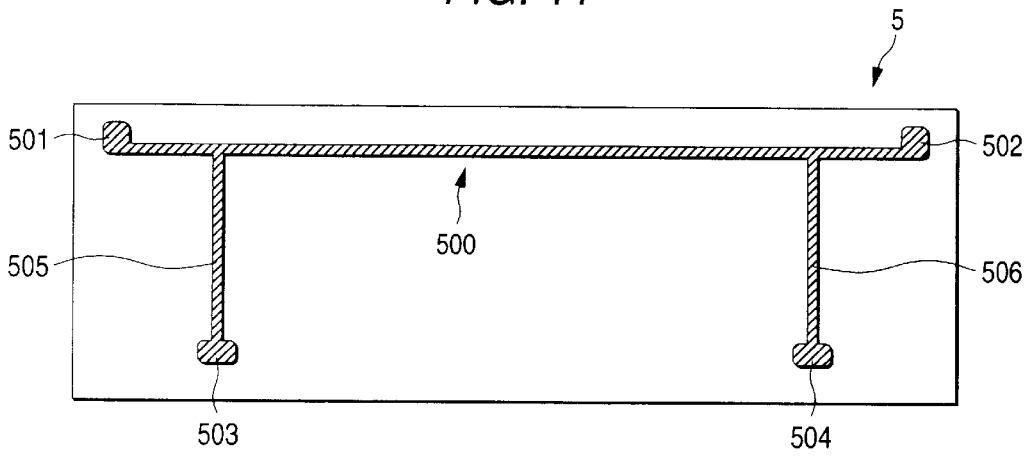
FIG. 11 is a top view showing the continuity pattern of a substrate constituting the ink-jet recording head.

The substrate 5 is a glass epoxy substrate as shown in FIG. 11 and a conductive pattern 500 provided with terminal parts 501 and 502 connected respectively via the windows 251*a* and 252*a* of TCP 2 and terminal parts 503 and 504 connected respectively via the windows 261*a* and 263*a* is formed.

Hereby, when TCP 2 and the substrate 5 are soldered in the areas of the windows 251*a* to 263*a*, common connecting terminals 261*b* and 263*b* at the end are respectively connected to the grounding conductors 251 and 252 via conductive patterns 505 and 506 of the substrate 5.

Hereby, when bonding between TCP 2 and the substrate 5 is finished, the recording head is completed by bonding each terminal of TCP 2 to the terminal electrode of the head chip 1 as in the above embodiments by the anisotropic conductive film 6 and soldering.

In this embodiment, as in the above embodiments, as the recording head is also miniaturized by connecting one TCP 2 to plural actuator units 30 and the plural grounding conductors 251 and 252 of TCP 2 are connected via the common terminal electrode of each actuator unit 30 and the conductive pattern of the substrate 5, the common terminal electrode of each actuator unit 30 is grounded at the minimum floating potential and an electric field applied to the piezoelectric vibrator 34 is equalized. Hereby, the displaced quantity of the piezoelectric vibrators 34 of the whole head chip is fixed, fixed quantity of ink can be stably jetted from each nozzle aperture 111 as an ink droplet and high quality of printing is enabled.

Figure 12:
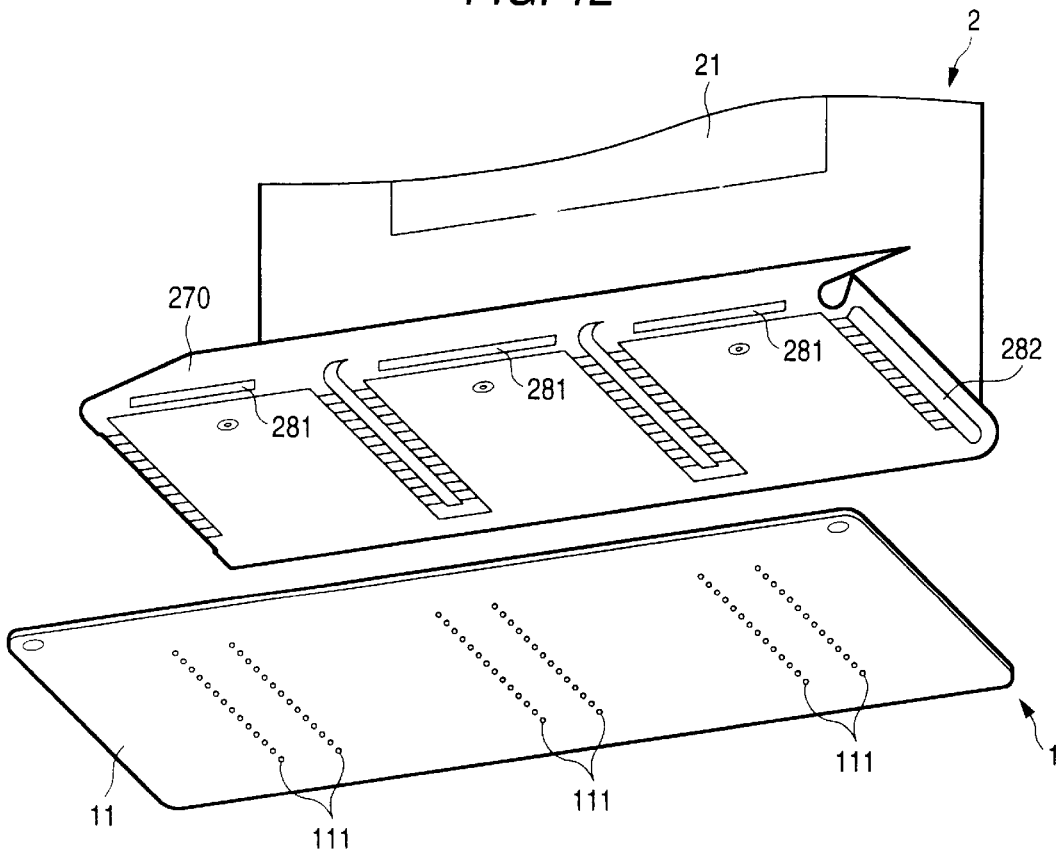
FIG. 12 is an exploded perspective drawing showing a fourth embodiment viewed from the side of a nozzle aperture of the ink-jet recording head according to the present invention.

FIGS. 12 and 13 show a fourth embodiment of the ink-jet recording head according to the present invention, in this embodiment, the substrate 5 in the third embodiment is formed by TCP 2, and the end and both sides of TCP 2 are bent.

Figure 14:
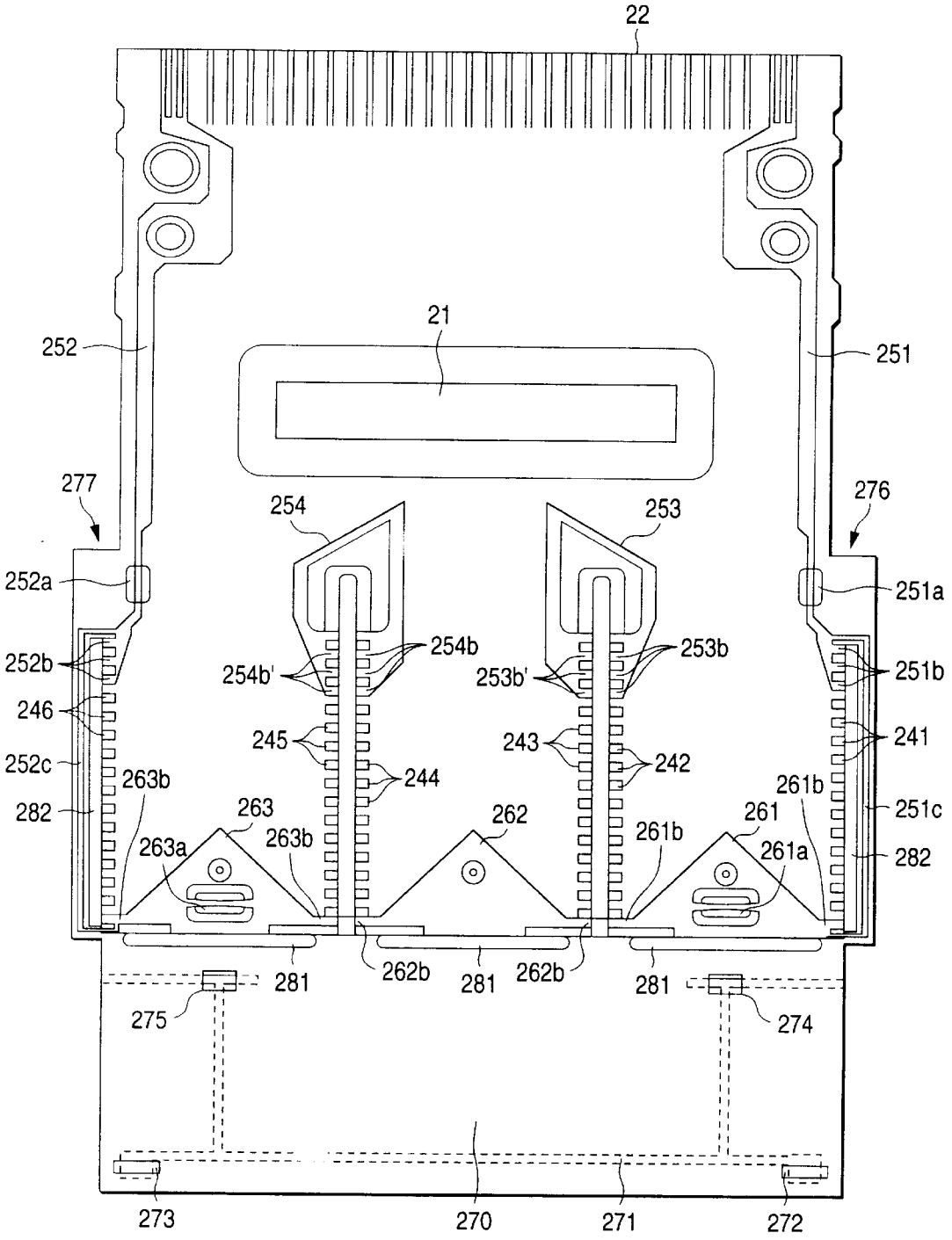
FIG. 14 is a top view showing the structure of TCP used for the ink-jet recording head.

In TCP 2, an auxiliary wiring part 270 which fulfills the similar function to the above substrate 5 is formed at the end as shown in FIG. 14 with plural slits 281 between the auxiliary wiring part and the semiconductor integrated circuit.

In the auxiliary wiring part 270, a conductive pattern 271 in the same shape as the conductive pattern 500 of the above substrate 5 is formed. Windows 272 and 273 for exposing terminal parts to which the conductive pattern 271 conducts via windows 251*a* and 252*a* of TCP 2 when TCP is bent with the slits 281 in the center and terminal parts 274 and 275 which conduct via windows 261*a* and 263*a* are formed.

On both sides of an area in which terminals 241 to 246 respectively connected to a head chip 1 are formed, extended parts 276 and 277 are formed with the slits 282 between and auxiliary grounding conductors 251*c* and 252*c* for connecting common electrode terminals 261*b* and 263*b* are formed on the surface of these.

In this embodiment, as shown in FIGS. 12 and 13, the extended parts 276 and 277 of TCP 2 are respectively bent inside with the slits 282 in the center, next, the auxiliary wiring part 270 is bent with the slits 281 in the center, grounding conductors 251 and 252 respectively exposed from the windows 251*a* and 252*a* of TCP 2, the conductive pattern 271 exposed from the windows 272 and 273 of the auxiliary wiring part 270 and grounding areas 261 and 263 respectively exposed from the windows 261*a* and 263*a* of TCP 2 are soldered for continuity, and the auxiliary wiring part 4 and TCP 5 are fixed with them bent. The ink-jet recording head is completed by soldering TCP 2 bent in a predetermined shape and reduced as described above on the head chip 1.

In this embodiment, the recording head can be thinned by the quantity because it has no substrate 5, simultaneously as in the above embodiments, the plural grounding conductors 251 and 252 of TCP 2 are connected via the common terminal electrode of each actuator unit 30, further, as the common terminals 251*a* and 251*b*, 252*a* and 252*b* in an area at the end in a direction in which common electrodes on both sides are arranged are connected via the auxiliary grounding conductors 251*c* and 252*c* in the extended parts 276 and 277, the common terminal electrode of each actuator unit 30 is grounded at the minimum floating potential and an electric field applied to each piezoelectric vibrator is equalized. Hereby, the displaced quantity of each piezoelectric vibrator in the whole head chip is fixed, an ink droplet can be stably jetted from each nozzle aperture 111 and high quality of printing is enabled.

In this embodiment, flexible cable components are effectively utilized by forming the auxiliary wiring part 270 at the end, however, similar action is produced by forming the auxiliary wiring part 270 in a cross direction, that is, forming it on one side or on both sides as the extended part 276 in FIG. 14 and forming it in size enough to reach the windows 251*a*, 252*a*, 261*a* and 263*a* when bent.

What is claimed is:

1. An ink-jet recording head, comprising:

plural nozzle apertures for jetting ink;

an actuator unit having a piezoelectric vibrator for expanding and reducing the volume of pressure generating chambers communicating with said nozzle apertures, segment terminal electrodes corresponding to said piezoelectric vibrator and connected to one pole of said piezoelectric vibrator, and common terminal electrodes arranged at opposite ends of said actuator unit in a direction in which said segment terminal electrodes are arranged and connected to another pole of said piezoelectric vibrator;

a tape carrier package having segment terminals connected to said segment terminal electrodes, common terminals located at one end of said segment terminals and connected to said common terminal electrodes and grounding conductors connected to said common terminals; and connecting members for connecting said common terminal electrodes to each other.

2. An ink-jet recording head according to claim 1, wherein a semiconductor integrated circuit is mounted on said tape carrier package.

3. An ink-jet recording head according to claim 1, wherein said common terminal electrodes are connected in a central area of said actuator unit.

4. An ink-jet recording head according to claim 1, wherein said connecting member is formed in said actuator unit.

5. An ink-jet recording head according to claim 3, wherein said connecting member is formed in an area in which said other pole is connected in common.

6. An ink-jet recording head according to claim 1, wherein said connecting member is of a conductive pattern on a substrate.

7. An ink jet recording head according to claim 6, wherein said tape carrier package is folded so as to place said substrate in between bent parts.

8. An ink-jet recording head according to claim 1, wherein said connecting member is comprised of a conductive pattern which is formed in an area extended from said tape carrier package said area foldable at slits thereof.

9. An ink-jet recording head according to claim 7 or 8, wherein said conductive pattern includes a pattern formed on both sides of said tape carrier package for connecting said grounding conductors to each other.

10. An ink-jet recording head according to claim 1, wherein each surface of said segment terminal electrodes and said common terminal electrodes is protruded from the surface of said piezoelectric vibrator, and a space is secured between said tape carrier package and said piezoelectric vibrator.

11. An ink-jet recording head according to claim 10, further comprising a dummy piezoelectric vibrator formed by the same material as said piezoelectric vibrator, wherein said segment terminal electrodes and said common terminal electrodes are formed on the surface of said dummy piezoelectric vibrator.

12. An ink-jet recording head according to claim 1, wherein said plural actuator units are provided, said tape carrier package having segment terminals connected to said segment terminal electrodes of said actuator unit and having the relation of continuity to an input signal pattern for transmitting an input signal from an external device and a common terminal located at both ends of said segment terminals and connected to said common terminal electrodes, and said common terminal electrodes arranged at both ends of said segment terminal electrodes are connected via a connecting member.

13. An ink-jet recording head according to claim 1 or 12, wherein a conductive pattern for connecting said common terminal electrodes of adjacent actuator units is formed on the side of said semiconductor integrated circuit on said tape carrier package.

14. An ink-jet recording head according to claim 12, wherein a conductive pattern for connecting said common terminal electrodes is divided into plural parts.

15. An ink-jet recording head according to claim 12, wherein an extended part provided with a pattern for connecting said common terminal electrodes arranged at both ends of said segment terminal electrodes is formed on a side outside an area in which said segment terminal electrodes and said common terminal electrodes are formed of said tape carrier package so that the extended part can be bent.

16. An ink-jet recording head according to claim 1 or 12, wherein said common terminal electrodes on the side of said input signal pattern and said common terminals are respectively divided into plural parts.

17. An ink-jet recording head according to any one of claim 1 or 12, wherein said actuator units are arranged in such a way that said grounding conductors are located at opposite ends of a set of said actuator units.

18. An ink-jet recording head according to claim 1, wherein said segment terminals and said common terminals formed on said tape carrier package are connected respectively to said segment terminal electrodes and said common terminal electrodes formed on said actuator unit.

19. An ink-jet recording head according to claim 1, wherein said common terminals are located at opposite ends of said segment terminals.

20. An ink jet recording head according to claim 1, wherein said grounding conductors bridge said connecting members and said common terminal electrodes.

* * * * *